United States Patent [19]

Puskarz et al.

[11] Patent Number: 4,688,608

[45] Date of Patent: Aug. 25, 1987

[54] FILLING VALVES FOR CANS AND LIKE CONTAINERS

[75] Inventors: Stanley J. Puskarz, Summerville; Herbert S. Shalit, North Charleston; Shiva S. Singh, Goose Creek, all of S.C.

[73] Assignee: Figgie International, Inc., Richmond, Va.

[21] Appl. No.: 854,117

[22] Filed: Apr. 21, 1986

[51] Int. Cl.[4] ..... B65B 3/06

[52] U.S. Cl. ..... 141/39; 141/46; 141/57; 141/181; 141/281; 141/302; 141/312; 277/177

[58] Field of Search ..... 141/1-12, 141/37-66, 250-284, 285-310, 129-191, 114, 10, 68, 312-317; 277/173, 177

[56] References Cited

U.S. PATENT DOCUMENTS 4,418,924 12/1983 Mack ..... 277/177

4,442,873 4/1984 Yun ..... 141/46

*Primary Examiner*—Houston S. Bell, Jr.

*Attorney, Agent, or Firm*—Oldham, Oldham & Weber Co.

[57] ABSTRACT

A filling valve mechanism for cans is presented. The valve includes a sleeve slidably mounted on a pair of pins and limited in downward motion by means of a stop. The sleeve carries an O-ring circumferentially thereabout for engaging within the throat of a container or can to be filled. The O-ring is of slightly greater diameter than the throat of the can such that sealing engagement is achieved. Also carried on the sleeve is a resilient compressible stripping member adapted for engaging the mouth of the can. The stripping member compresses against the mouth of the can, short of full compression by virtue of the limited downward movement of the sleeve against the stop. After the can is filled, the stripping member urges the O-ring from the throat of the can while holding the can in place.

16 Claims, 1 Drawing Figure

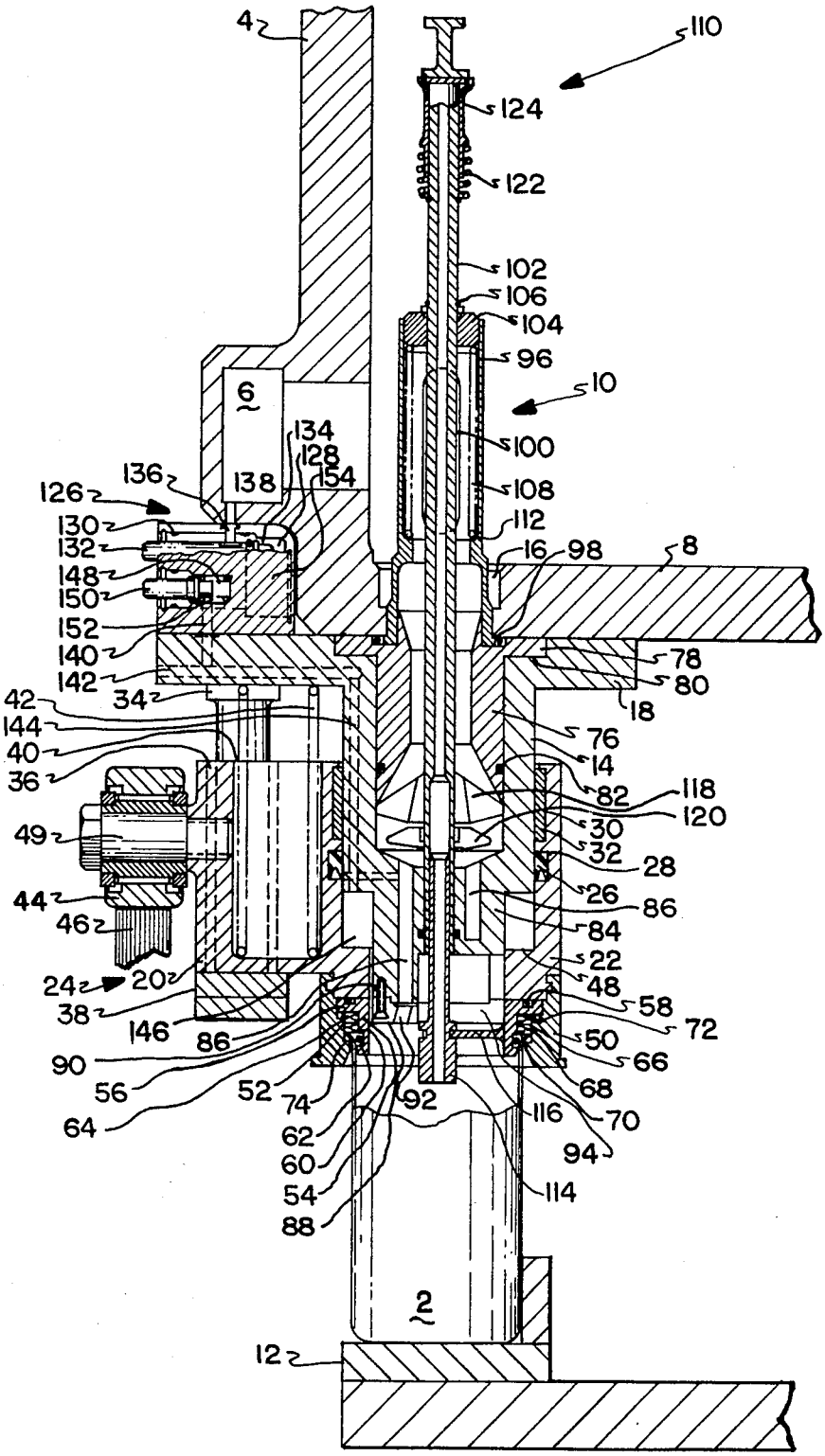
4
110
124
122
102
106
104
96
10
6
100
134
128
154
108
136
138
126
112
130
16
98
8
132
148
150
152
140
142
78
80
34
18
42
144
76
40
14
36
82
118
120
49
30
32
28
44
26
86
46
84
22
24
20
48
38
58
146
86
72
50
90
66
56
52
74
92
68
64
116
70
62
94
60
54
114
88
2
12

FILLING VALVES FOR CANS AND LIKE CONTAINERS

TECHNICAL FIELD

The present invention relates to a valve mechanism for use in counter-pressure type filling apparatus and more particularly relates to valve mechanisms for filling cans and analagous containers with a liquid product such as beer, soda water and/or other types of carbonated and non-carbonated liquids and which incorporate a vertically movable centering member adapted to engage the container during the course of a filling cycle to both center and seal the same with respect to the valve mechanism.

BACKGROUND OF THE INVENTION

In filling apparatus of the type with which the present invention is primarily concerned, the containers which are to be filled with liquid product such as beer or carbonated soft drink, for example, are continuously maintained in a fixed horizontal plane in entering into, moving through and exiting from the filling machine and the individual filling valves are provided with vertically movable centering sleeves adapted to be lowered onto the containers after entry into the filler to provide both for the centering of the can relatively of the valves and the sealing of the can to the valves A filling valve of this general type is shown and described in detail in U.S. Pat. No. 3,807,463, dated Apr. 30, 1974, assigned to Holstein and Kappert.

As shown in the aforesaid patent, the centering sleeve is movable under the control of a shifter mechanism or other suitable means between an elevated position above the plane of the incoming containers whereby to allow the latter to enter freely into the filler and a lowered or operative position in which a resilient sealing ring or gasket carried in the lower end of the sleeve is in engaged, sealing relation with the rim or mouth of the container. The sleeve remains in engaged, sealing relationship with the can or other container as the latter is first counter-pressurized and then filled to a pre-determined level with liquid product. When filling is completed, the sleeve is caused to be raised from the can or other container by its associated shifter or other actuator mechanism to permit the filled can to move out of the filler mechanism. With this valve design, the can remains in a fixed, horizontal plane while moving into, through, and off the filler onto the seamer transfer, thus, insuring maximum can stability and minimum product agitation during the course of the filling operation. At the same time, by moving the sleeve vertically rather than the cans themselves as in conventional filler apparatus, there is no requirement for lift cylinders. This results in a filler of substantially overall simpler construction and one which is far easier to maintain.

The advantages of this general type of valve are well known in the industry but there remain a number of limitations or drawbacks preventing an even wider acceptance of such valves. For one thing, these valves are still somewhat complicated of construction and design, particularly as concerns the mechanism for controlling the vertical movement of the sleeve member. Because of this, the reliability and efficiency of this type of valve has been adversely affected. Additionally, the cost of manufacturing the valve has been relatively high, along with maintenance costs.

Then too in these valves wherein the sealing of the can to the valve is effected by the engagement of a resilient gasket carried in the lower end of the sleeve with the rim or mouth of the can, a sufficient pressure or force must be exerted on and between the can and sleeve to cause sealing compression of the gasket. This force may typically be derived from a suitable compression spring associated with the movable sleeve or through a toggle linkage of the over center acting type which when activated moves the sleeve into sealing engagement with the can and holds the same in place during the course of the filling cycle.

In either case, the forces against the can may become fairly appreciable and, in filling certain cans particularly those of deep drawn construction and formed of a lightweight readily deformable material such as aluminum, these pressures or forces can cause a crumpling or deformation of the can. Obviously, in any such eventuality, the can will not be properly filled and necesarily must be discarded or removed from the filling machine. With the increasing usage in industry of aluminum cans having wall thicknesses of ever decreasing gauge, there is a clear and present need for a valve which can sealingly engage the can with a minimum of force or pressure exerted against the sidewalls of the can.

A further concern in the use of these lightweight aluminum cans in present day canning lines of breweries and soft drink plants stems from the high susceptibility of these cans to denting or crumpling during handling in the filling line. The rims or upper ends of these cans are particularly susceptible of becoming out-of-round and/or sustaining dents or deformities in the course of being removed from storage and placed into the stream of cans in the filling lines.

Inasmuch as the mouth of the can is required to register with the gasket in the centering sleeve to form a seal with the valve, it becomes almost impossible or exceedingly difficult to properly seal the can to the filling valve if the mouth of the can is nicked or dented. Inevitably in these instances, the can cannot receive any liquid or receives less than the desired quantity of liquid, requiring the can and product to be discarded. Filling efficiencies are thereby adversely effected and overall costs of operation are increased as a consequence.

DISCLOSURE OF THE INVENTION

This invention has, as a first aspect, the provision of a filling valve particularly suited for use with lightweight, readily deformable containers or cans and which includes a novel and improved form of a centering and sealing means adapted to engage the containers for sealing action with a minimum of force or pressure being exerted against the container.

A further aspect of the invention is the provision of a filling valve for use with lightweight readily deformable cans and like containers and having a novel centering and sealing means designed to engage the cans for sealing action axially inwardly of the rim or mouth thereof whereby to permit the ready sealing and accurate filling of cans of imperfect circularity and/or cans having irregularities (dents, nicks, etc.) in the rim or mouth portions thereof.

An additional aspect of the invention is the provision of a filling apparatus for cans and the like and having an improved and simplified form of sealing means adapted to sealingly engage lightweight aluminum cans in such a way as will cause cans having slight irregularities insofar as their circularity is concerned to be reformed and restored to a condition of true circularity.

Another aspect of the invention is to provide a filling apparatus for cans and the like with a sealing means of improved efficiency while having a simplified and inexpensive construction.

An additional aspect of the invention is to provide filling apparatus of the type having a movable sleeve for engaging cans or other like containers for centering and sealing action with means for positively restricting the movement of the sleeve relatively of the can or other container whereby to prevent excessive sidewall loading of the can during the course of a filling cycle.

Still another aspect of the invention is to provide filling valve apparatus for cans and the like with means integral with the apparatus for effecting a positive force urging the can relatively from the apparatus at the conclusion of the filling cycle whereby to reduce the propensity of the can to hang-up in the filler when filling is completed.

Further aspects of the invention are to provide improved and simplified means for carrying out the filling of lightweight cans, to obtain improved filling efficiencies in counter-pressure type filling apparatus, and to provide readily controllable and adjustable filling apparatus capable of rapidly and accurately filling a wide range of containers of various materials, wall thicknesses and heights including those of thin walled aluminum sheet stock.

These and other aspects and advantages of the present invention are achieved by a filler valve mechanism particularly adapted for filling cans and like containers with carbonated liquids, e.g., beer and soft drinks, and embodying the combination with a fixed inner valve body having a cylindrical construction of a centering sleeve slidably mounted to the valve body. Mounted within the lower end of the sleeve is a sealing ring in the form of an O-ring positioned to frictionally engage the inner periphery of the can below the rim or mouth thereof when the sleeve is moved to a lower slide position on the valve body, and stripping means including a resiliently compressible wave spring adapted to yieldingly engage the can interior whereby to forcibly constrain the container against movement with the sleeve when the filling cycle is completed.

The support structure for the sleeve includes a pair of fixed pins carried by the valve body and extending through an extension of the sleeve, a spring normally biasing the sleeve to a lower slide position on the valve, and a plate connecting the lower end of the pins and forming a fixed stop or abutment limiting downward slide movement of the sleeve on the valve. Also associated with the sleeve is a cam roller adapted to engage a fixed cam in the filler to control the sleeve for vertical movement on the valve body.

The roller and cam co-act at the point in the filling cycle where the cans enter into the filler to raise the sleeve on the valve sufficiently to allow the cans to move freely thereinto and into a position below and in registry with the individual filler valves. The cam configuration is such as to allow the sleeve to then move downwardly under its own weight and the bias of the spring, the roller eventually riding off the cam track and the sleeve ultimately moving to a position of rest against the fixed abutment or stop.

In the course of this downward movement of the sleeve, the wave washer is caused to move into contact with and exert a light pressure or force axially against the sidewall of the container substantially concurrently as the O-ring frictionally contacts the can interior to thereby seal the can to the valve mechanism. The sleeve remains in a lower slide position on the valve with the O-ring in sealing relation to the can as the various stages of the filling cycle take place. When filling is completed, the cam roller re-engages the fixed cam to force the sleeve upwardly against the bias of the actuator spring sufficiently to withdraw the O-ring out of the can and thereby free the can for discharge from the filler. The sleeve is then maintained in the upper slide position by the roller and cam track preparatory to the initiation of another filling cycle with an incoming empty container.

With the improved valve means of the invention, sealing action of the sleeve is provided along the inner wall of the container rather than with the rim or mouth thereof and, as a result of this, the only downward force of the sleeve against the cam is from the wave washer. Inasmuch as this force on the can is solely for the purpose of facilitating the separation of the sleeve from the can at the conclusion of the filling cycle, only a rather light force need be exerted on the can to assure the desired can-sleeve separation. As a result of this improved sealing arrangement, the valves of the invention may be utilized to carry out the filling of containers of extremely lightweight construction with little or reduced risk of the can sustaining crushing, crumpling or other damage during the various stages of the filling cycle.

Furthermore, with the improved valves of the invention, the O-ring sealing means in entering into a container and frictionally engaging along the inner wall thereof tends to reform or reshape the wall so as to conform the same to the contour of the O-ring as seated on the reduced end of the centering sleeve. Cans entering the filler in a damaged or deformed condition may, as a result of the reforming action of the O-ring, be restored to true cylindrical shape to permit normal handling and accurate filling thereof in the filler apparatus. Also, with the seal being formed interiorly of the can an effective seal may be obtained with cans having dents or other irregularities in the rim or mouth region thereof and thus, such cans may also be processed in the filler apparatus for rapid and accurate filling action.

A particular feature of the invention is the provision in the valve apparatus of a fixed stop or abutment which serves to limit the sleeve for downward movement relatively of the valve proper. Normally, the stop will be positioned such that the O-ring will seat securely within the container which is to be filled with liquid and the wave washer will engage the lip of the container and undergo a degree of compression prior to the sleeve bottoming out against the stop.

In accordance with a further aspect of the invention, the sleeve defines with the valve proper an internal pressure chamber of a diameter equal to or slightly less than the inside diameter of the cans with which the valves are to be used. The chamber is adapted to communicate with the interior of the can when the latter is in sealed relation with the valve such that when the can is pressurized in the initial stages of the filling cycle, the forces tending to cause the sleeve to move upwardly and away from the can are almost offset by the opposed force developed in the pressure chamber, tending to hold the sleeve against the can. The balancing of these forces from the pressurization of the can results in the sleeve being held to the can substantially solely by the bias force of the sleeve actuator spring and, as this force is taken-up by the compression of the stripping means, the can is under a minimum of pressure during filling.

The valve of the invention utilizes relatively simplified, reliable means for carrying out the sealing of the can to the centering sleeve and for effecting the stripping of the filled cans from the sleeve in the final stages of the filling cycle and thus valve costs both with respect to manufacture and maintenance may be kept to a minimum. The improved valve of the invention is capable of carrying out the high speed, accurate filling of containers—including cans formed of lightweight sheet stock of aluminum or other readily deformable stock. Other features, objects and advantages of the invention will become readily apparent in the course of the following description of a presently preferred embodiment of the invention when taken in conjunction with the accompanying drawing.

DESCRIPTION OF THE DRAWING

For a complete understanding of the objects, techniques, and structure of the invention, reference should be had to the following detailed description and accompanying drawing wherein there is shown a cross sectional view of the filling valve of the invention.

BEST MODE FOR CARRYING OUT THE INVENTION

With reference now to the drawing, a portion of a counter-pressure filling apparatus for filling cans 2 or analogous containers with a beverage such as beer, includes a sealed bowl or vessel 4 of annular construction containing the beverage and a superposed body of compressed gas, $CO_2$ for example. Vessel 4 is surrounded by a second sealed chamber 6 of ring-like construction and is connected by suitable means to a source of vacuum, not shown.

Mounted in depending relation from the bottom wall 8 of vessel 4 are a series of identical filling valves 10, one only of which is shown, arranged in equi-spaced relation to one another around the periphery of the bowl as is well known in the art to which the invention appertains. The filler further comprises a series of individual supports or platforms 12 for the cans or other containers and which are arranged in the filler apparatus below and in vertically aligned relation with corresponding filler valves. The supports or platforms 12 and associative support structure form with the bowl or vessel 4 a unitary assembly or structure which is rotatable about a vertical center axis to advance the cans or other analagous containers through a filling cycle and relatively from an infeed station (not shown) to a second or discharge station (also not shown). According to the invention, the filling valves are of a design which enables the cans to remain in a fixed horizontal plane during movement through the filler from the first to the second transfer station. Each of the valves comprises a fixed housing 14 secured directly opposite to and in vertically aligned relation with a liquid outlet opening 16 in the bottom wall of the filler bowl or vessel by machine screws, bolts or the like extending into the wall through a flange 18 on the upper end of the housing. Mounted to the housing is an axially movable centering sleeve 20 having a body portion 22 of annular construction and an offset side portion 24 of generally rectilinear configuration. The sleeve is sealed to the housing by a packing ring 26 carried in a circumferentially extending groove 28 in the interior of the sleeve body portion 22. Another such groove, indicated at 30, in the sleeve body portion receives a bushing 32 of plastic, for example, which serves to take-up wear between the slide surfaces of the sleeve and housing.

The sleeve is guided for slide movement on the housing by means comprising a pair of vertical guide pins 34 secured to the aforesaid housing end flange 18 and extending through corresponding, opposed vertical openings 36 provided in the rectilinear portion 24 of the sleeve. The pins are connected at their lower ends by a plate 38 forming a stop or abutment limiting the sleeve for downward slide movement on the housing. The portion 24 is further provided with a vertically extending recess or opening 40 located midway between openings 36 for receiving a compression spring 42 which acts between housing flange 18 and the sleeve to bias the latter to a normal lower slide position on the housing.

The sleeve has an actuator roller 44, associated therewith and which coacts with a fixed cam 46 mounted at a preset position on the periphery of the filler to control the slide position of the sleeve relative to the housing. Roller 44 is journalled to a fixed shaft 49 mounted horizontally within the extension midway between the guide pin openings 36. As will be more fully explained hereinafter, the roller and cam are designed to act together against the weight of the sleeve assembly in combination with the bias force of the spring to move the sleeve controllably between raised and lowered positions on the housing as the filler head and container support table are rotated in unison about their center axis to move the successive containers through their respective filling cycles. The lower end of the sleeve is stepped radially inwardly as indicated as 48 and carries a cylindrical member or ring 50 defining with the reduction a circumferentially extending recess or annulus 52 within the interior of the ring. Mounted within the recess is a flanged ringlike member 54 surmounted to the axial reduction 48 with its flanged end 56 in abutting relation with a radially extending shoulder 58 formed exteriorly on sleeve 22. Member 54 is provided with a circumferentially extending groove 60 forming a seat for an O-ring 62 of rubber or other resiliently elastic material adapted to frictionally engage the inner wall surface of a container such as a can when in filling relation with the valve apparatus to form a gas seal between the can and valve.

The recess further receives a wave spring and washer assembly comprising an upper wave spring 64 seated upwardly against the flanged portion 56 of the ring member, an intermediate retainer washer 66 engaging the wave spring along one face thereof, and a lower wave spring 68 mounted in the recess below and in contact with the stripper washer 70. The ring extension 50 is provided with first and second interior abutments 72 and 74 defining seats for the spring and washer 64 and 70 respectively whereby to hold the latter in place in the recess with the ring 50 in assembled relation to the sleeve 22. In the preferred embodiment of the invention, ring and sleeve are provide with mating pins and grooves for forming a connection therebetween and, in the assembled positon of the ring, the wave spring is held loosely between the spring and washers 64 and 70. The stripping washer 70 is positioned to engage with the upper edge or mouth portion of a can to exert an axial force against the can sidewall tending to move the can away from the valve proper. This axial force, together with the weight of the can and its liquid contents, tend to hold the can stationary as the sleeve is lifted upwardly on the housing at the conclusion of the filling operation thereby to facilitate valve or sleeve separation from the cans and overcome the tendency of the can to adhere to the O-ring 62 as the latter is lifted with the sleeve. It is apparent that the force exerted on the can by the wave spring and washer assembly and hence the relative ease with which the can will be stripped from the sleeve will depend on a number of factors, such as, for example, the relative stiffness (or lack of same) of the wave springs 64,68, the extent of compression of the springs upon the sleeve reaching maximum extension on the housing subsequent to engaging the can in the course of a filling cycle, the mass of the sleeve and the bias force of the actuator springs, etc. By properly relating these various factors to one another, the force on the can tending to hold the same against its support platform 12 may be regulated as needed to provide a desired stripping of the sleeve from the can when filling is completed.

The upper end of the housing 14 contains a bonnet 76 having an upper external flange 78 which seats in a suitable counterbore 80 in the housing flange 18 to fix the bonnet axially. A packing ring 82 is secured in a groove in the outer periphery of the bonnet to seal the latter to the housing. The lower end of the housing contains a core 84 formed with a pair of arcuate slots or openings 86 defining a channel or passageway for liquid flow through the valve. A liquid cover 88 of ring-like construction is secured to the lower end of the core as by a number of machine screws 90. Cover 88 is provided with a pair of slots 92 of similar configuration to the slots 86 in core 84 and flared outwardly in proceeding along their length so as to impel the liquid flowing through the valve outwardly towards the sides of the can as it exits from the slots 92. The core and cover have corresponding portions cut-away as indicated at 94 for purposes to be explained hereinafter.

The novel filler valve of the invention further comprises a tubular spring cage 96 mounted vertically within the liquid bowl in axially aligned relation with the housing and bonnet, the latter being extended upwardly within the cage as shown to maintain the cage in alignment with the bonnet. Cage 96 is held in place through means of a flange 98 formed on the lower end of the cage and seating against the outer surface of the vessel bottom wall 8, there being a suitable recess in the face of the bonnet flange 78 to receive the cage. A gasket is also received in the recess to seal the cage and bonnet to the wall 8.

The cage extends above the liquid level in the bowl and is provided with one or more enlarged side openings 100 to permit liquid to freely enter the cage from the bowl. Mounted axially within the cage is an elongated gas conduit or tube 102 terminating at its lower end in an axially extending bore in the aforesaid core 84 of the housing. The upper end of the cage slidably receives a centrally apertured closure or cap member 104 fitting coaxially of the tube and adapted to engage or seat against an O-ring collar assembly 106 affixed to the tube at a position above the cap member. A helical compression spring 108 contained within the cage acts between cap 104 and a shoulder 112 formed in the cage to yieldingly oppose the gas tube for downward sliding movement in the cage.

The gas conduit or tube is provided with a lower extension in the form of a vent tube 114 mounted coaxially within the tube by means of a bracket or arm 116 formed as an integral part of the aforesaid sealing ring 54. The bracket has a bifurcated inner end seating within a groove in an enlargement on the lower end of the tube. Bracket 116 is mounted to the sealing ring 54 generally in vertical alignment with the cut-away portions 94 of the core and liquid cover so as to permit the bracket to move vertically with the sleeve without hinderance from the core or cover. It is to be appreciated that the vent tube itself is likewise free to move vertically with respect to the gas charging tube as the sleeve is raised and/or lowered on the housing.

The aforesaid liquid channel or passageway 86 in the core 84 is adapted to be controlled for opening and closing action by means of a liquid valve which is secured to the gas tube above the passageway. The valve has a series of winglike projections 118 adapted to guide the valve for vertical sliding movement in the housing with the gas tube and includes a lower disc-like element 120 of rubber or other elastic or resiliently deformable material having a conically tapered lower face or wall surface. The surface of the housing surrounding the inlet to the passageway is preferably provided with a complementary tapered or contoured valve seat for the surface of the element 120.

The upper end of the gas tube which as previous indicated projects above the level of liquid in the vessel carries a tubular valve elements 110 which is closed at its upper end by a suitable resilient plug or gasket carried in a valve charging cap in standard fashion. The valve body is formed intermediate its ends with a circumferentially extending shoulder constituting a seat for a helical compression spring 122 secured to the tube at its lower end by O-ring means located in a groove or recess in the tube. The upper end of the tube is provided with a transverse opening 124 for communiating the gas space in the vessel with the interior of the gas tube or conduit when the tube is in a normal raised slide position on the gas tube. The valve cap is adapted to be moved vertically with respect to the gas tube to control gas flow therethrough by means of a cam controlled actuator, not shown, mounted externally of the filler bowl directly opposite the valve cap and formed with an arm or fork, also not shown, extending inwardly of the bowl to engage the cap intermediate its ends, all of which is previously known in the art.

The valve of the invention further comprises a combined snift-block and vacuum valve assembly indicated as a whole in the drawing by the reference numeral 126. The assembly has a generally rectangular block or body portion supported in a recessed wall portion of the liquid bowl by flange 18 of the valve housing. The block includes an upper valve chamber or recess 128 receiving a bushing 130 secured in place in the block by an expansion clip or other conventional fastening means. A valve stem 132 is slidably received in the bushing and carries an O-ring packing forming a shoulder limiting the stem for outward slide travel in the recess and/or bushing. The stem is normally biased to an outer slide position in the chamber with the O-ring in sealed, abutting relation with the bushing by a compression spring 134 disposed in the inner end of the chamber. The block is provided with a vertical bore or passage 136 communicating with the chamber 6 by way of a transverse opening in bushing 130 and with the aforesaid vacuum chamber 6 by way of an opening 138 in the vacuum chamber 6. The inner end of chamber 128 communicates by way of a vertical passageway 140 in the block with a horizontally extending passageway 142 formed in the outer flanged portion of the housing and which is closed to the atmosphere by a suitable packing or plug located in the outermost end of the passageway. Housing 14 contains a further passageway 144 vertically the length of the housing to an annular pressure chamber 146 formed interiorly of the valve by and between the sleeve and housing, the lower end of the housing being of radially inwardly stepped construction and the corresponding lower end portion of the sleeve having an inwardly extending wall portion of generally complementary configuration to the housing. A clearance is provided between the sleeve and housing pressure chamber 146 such that with a can or other container in centered, sealed relation with the sleeve the interior of the can is in communication with chamber 128 via the pressure chamber 146 and interconnecting passageways 140,142,144. Valve stem 132 is cut-away ahead of the O-ring packing such that with the stem in a depressed condition in the recess 128, vacuum chamber 6 will be in communication with the interior of the recess 128 whereby to establish communication, in turn, between the can and vacuum chamber 6 by way of registering openings 136 and 138 in the block and vacuum chamber ring 6 respectively.

The valve stem 132 is adapted to be depressed at a predetermined point in the filling cycle whereby to permit a can in centered, sealed relation with the valve to be placed under vacuum by means of a suitable fixed cam (not shown) mounted along the periphery of the filler bowl, slightly subsequent to opening of the tubular valve element 110.

The block is provided with a further valve chamber or recess 148 located directly below the valve chamber 128 and also mounting a bushing held in place as by a retaining ring or other conventional fastening means. A valve stem 150 is slidably mounted in the bushing and has an externally grooved inner end portion receiving an O-ring adapted to engage the inner end of the bushing to limit the stem for outward sliding movement in the recess. The stem is normally biased to an outer slide position in the chamber with O-ring in sealed, engaged relation with the inner end of the bushing by a compression spring 152 seated between the inner or blind end of the recess and the inner end of the stem. The outer end portion of the valve stem 150 is provided with a longitudinally extending flat such that with the stem in a depressed position in the recess the inner end of the recess is in free and open communication with the atmosphere. A vertical passage 140 in the block leads from the inner end of chamber 148 to the aforesaid horizontal passageway 142 in the housing flange 18 such that when the stem 150 is depressed, communication between the atmosphere and the interior of a can in filling relation with a valve will be established. As with the stem 132, a fixed cam (not shown), is mounted along the periphery of the filler bowl to engage and depress the valve stem 150 at a predetermined point in the filling cycle and thereby connect the interior of a can with atmospheric pressure.

The block contains a still further chamber 154 opening to the inboard face of the block and normally closed to the atmosphere by a plug in the open end of the chamber. The inner end of chamber 154 is in communication with passageways within housing 14 to liquid passage 86. The chamber 154 is thus in free and open communication with the valve interior and, in turn, with the interior of a can when in filling position to the valve. As will be more fully explained hereinafter, in the filling operation, the can is initially pressurized through the gas charging tube 102 and a gas pressure builds-up in the can, it will build-up in the chamber to an equal value. When the filling cycle is completed and the stem 150 is depressed, the pressure in the chamber will be relieved to the atmosphere and any residual liquid in the core 84 and liquid cover 88 will be blown into the can.

The aforesaid pressure chamber 146 defined between the sleeve and housing includes a radially extending wall or surface 48 on the sleeve and, in the course of the can being pressurized, act against such surface to urge the sleeve downwardly on the housing. At the same time, of course, the gas in the can or other container will act against the end wall of the sleeve to provide a countervailing force urging the sleeve to an upper slide position on the housing. The magnitude of these opposing forces is in direct proportion to the areas of the respective surfaces. In the preferred embodiment of the invention, the diameter of the chamber is only slightly smaller than the can diameter and thus these opposing forces on the sleeve are substantially in balance.

As a consequence of this design, the sleeve is at all times held to the can solely by the bias of the actuator spring 42 and there is no further build-up in the forces acting against the can and sleeve during the pressurization of the can as is the case in conventional apparatus of this type. The force on the can side walls from the sleeve may thus be kept to a minimum and yet a sufficient force is provided to maintain the can stationary on its support 12 as the O-ring 62 is pulled free of the can following the filling operation.

The following description of the overall operation of the filling apparatus of the invention will facilitate a better understanding and appreciation of the various novel features and advantages of the invention in carrying out the filling of containers such as cans with beer, carbonated soft drink or other like liquid product. Upon an empty can entering the filling machine, the centering sleeve of the filling apparatus will be maintained in a raised position on the housing against the bias of the actuator spring by the co-action between cam roller 44 associated with the sleeve and the fixed cam 46. The liquid valve will, at this time, be in a closed position as will the gas charging valve. As the can and its support move progressively about the periphery of the filler, the cam roller is permitted by the fixed cam to descend to cause a corresponding descending movement of the sleeve relatively of the can. In the course of the lowering of the sleeve, the latter will effect a centering of the can relatively of the valve. At the same time, the stripping assembly within the sleeve engages the rim or mouth of the can concomitantly as the O-ring seal 62 moves within the can and into frictional sealing contact with the inner surface or throat of the can. Upon the can becoming sealed to the valve apparatus and with the further travel of the can along the filler periphery, another of the fixed cams (not shown) engages the vacuum stem and causes the latter to slide into the block or housing. Such movement of the stem removes the gasket from the inner end of the bushing and permits gas or air to be drawn out of the can by way of the various passageways in the housing and snift-block. At this same time, the gas charging valve is caused to open by the outside cam lever, not shown, and interacting additional fixed cam, also not shown, on the filler periphery. The charging valve spring is thus permitted to slide upon the gas tube and thereby allow the gas space in the filler to communicate with the can interior. Gas pressure in the bowl will tend to flow into the can to cause an equalization of pressure therebetween under conditions of equilibrium. By maintaining the vacuum stem in a depressed condition while the gas charging valve is open, the bowl gas, typically $CO_2$, will tend to cause a flushing action in the can with the gas originally therein being drawn into the vacuum chamber and being replaced by $CO_2$. This flushing of the can is particularly advantageous in the filling of containers with beer as exposure to air is known to have a deleterious affect on the taste thereof and also cause an undesirable clouding of the beer during storage.

In any event, after this evacuation of the can and a partial or complete flushing thereof with $CO_2$, the vacuum valve stem is allowed to return to its normal outer position in the block whereby to cut-off further communication between the can and vacuum chamber. At this point, gas pressure will build up within the can and eventually the pressure of the gas acting upwardly against the liquid valve aided by the bias of the spring will overcome the force of the liquid column holding the valve in a closed position and the liquid valve will automatically open to allow liquid to flow into the can.

As liquid enters the can through the liquid passageway, gas is free to flow from the can and into the bowl through the vent tube and gas conduit, exiting from the latter through the opening in the gas charging body. The liquid and gas interchange in the can will continue to take place until such time as the liquid in the can rises to the level of the lower tip or extremity of the vent tube and closes the latter to the further flow of gas from the can. When gas flow from the can is cut-off, the further flow of liquid into the can automatically stops. The gas charging valve, which is still in an open position, is then closed by the exterior cam actuated operating lever (not shown). The liquid valve is also closed by this same lever forcing the valve cap downwardly into contact with the upper end of the counter-pressure stem and causing the stem to move downwardly in the housing sufficiently to cause the liquid valve to contact the valve seat. As the can continues in its movement along the periphery of the filler, the snift stem engages a fixed cam and is caused thereby to slide inwardly in the sniftblock to provide communication between the atmosphere and the can head-space by way of the various passages previously described. The headspace pressure in the can may thus be released to the atmosphere in a controlled manner while the can remains sealed to the valve apparatus through the medium of the O-ring seal. At this juncture, it is well to point out that the provision of the expansion chamber in the sniftblock produces a rapid and substantially complete evacuation of the liquid which remains in the liquid passageway after the aforesaid closing of the liquid valve. This liquid, if not otherwise ejected from the passage, tends to drip from the valve and cause contamination of the filling machine as a whole after the can and valve are separated and the can removed from the filler. Also, if this residual liquid is not blown out of the passages while the can is still in vertical registry with the valve, the liquid becomes wasted and, over a given period of time, this liquid waste can become quite appreciable and can have a significant adverse effect on the efficiency of the line. With the improved design of the invention, the liquid in the passage at the conclusion of the filling of the can and the closing of the liquid valve is recaptured or salvaged, thus enabling an improved, overall efficiency in the filling line while reducing contamination of the filler and the filling line in general from liquid loss through the valve.

When the headspace pressure in the can is relieved, the snift button returns to its normal outer slide position in the block in preparation for an ensuing filling cylce. The centering sleeve is caused to raise up from the can by the cam roller re-engaging the fixed cam on the filler periphery and as this happens, the wave washer acting through the stripper washer will hold the can in place to permit the sleeve to draw away from the can and the O-ring to pull free of the latter. Any tendency of the can to stick or adhere to the sleeve and move up with the sleeve as the latter is elevated is thereby positively overcome. Serious problems can, of course, result if the can does not separate smoothly from the valve when filling is completed and yet, with the improved design of the invention, there is no need to provide the filler with a special mechanical contrivance such as a deflector or analagous device to attain can-valve separation by striking the can at the point in its travel where it is to separate from the sleeve or valve. Such deflectors or similar means may cause the can deformation, and/or spillage of can contents with consequent loss of filler efficiency and decrease in line output.

Following the lifting of the sleeve from the can, the latter is removed from the filler and passes to a capping or seamer apparatus, not shown. The cam roller will be retained in a raised position relatively of the housing, by the fixed cam such that an incoming empty can may pass freely into a position of registry with the valve as the latter initiates movement through another filling cycle.

It is seen that with the improved filling apparatus of the invention, sealing contact between the valve and can is effected by the O-ring means engaging the inside wall portion of the can rather than the upper rim or mouth portion thereof as in conventional structure. Among other advantages, this type of seal permits the sealing of cans which may have slight imperfections (nicks, dents, etc.) in the rim or which may have become slightly out-of-round during processing in the canning line or in moving from the container warehouse or other storage or supply area to the canning or processing line. With cans becoming ever lighter in weight and of ever decreasing sidewall thickness, there is increased likelihood of can damage to or imperfections in the cans in present day lines and, thus, the apparatus of the invention is particularly well adapted for use in filling today's lightweight, relatively low strength containers.

Various modes of carrying out the invention are contemplated as being within the scope of the following claims particularly pointing out and distinctly claiming the subject matter regarded as the nature of the invention.

What is claimed is:

1. A filling valve mechanism for containers, comprising:

a hollow, tubular housing; and a generally cylindrical sleeve mounted co-axially of said housing for vertical movement relatively thereto and provided with a resiliently deformable sealing ring adapted to be received within and to engage outwardly against the inner wall surface of the container upon the sleeve being moved to a lowered slide position on the housing whereby to seal the container to the valve mechanism only about the inner wall surface of the container.

2. The filler valve mechanism of claim 1 wherein said sleeve is further provided with stripping means adapted to yieldingly engage the container from the upper end thereof upon the sleeve being lowered to the container whereby to forcibly constrain the container against movement with the sleeve upon the latter being moved to a raised position on the housing following the filling of the container with liquid, and means associated with the sleeve for controllably moving the latter between raised and lowered positions on said housing.

3. The filling valve mechanism of claim 1 which further comprises stop means for limiting the sleeve for downward slide movement on the housing, the limit position being such as to permit the sealing ring means to enter into and sealingly engage the container and the stripping means to yieldingly engage the container prior to the sleeve engaging said stop means.

4. The filling valve mechanism of claim 1 wherein said resiliently deformable sealing ring comprises an O-ring dimensioned to engage the sidewalls of the container upon the sleeve being moved to a lowered slide position on said housing.

5. The filling valve mechanism of claim 2 wherein said stripping means comprises a compressible member.

6. The filling valve mechanism of claim 5 wherein said compressible member comprises a wave washer.

7. The filling valve mechanism of claim 1 wherein said housing and sleeve are formed with complementary shaped extensions, and said sleeve is supported for slide movement relative of said housing by means including a pair of spaced pins fixedly connected at one end to the housing extension and slidably received within through openings provided in the sleeve extension, said pins closed at one end thereof by a plate constituting a stop means limiting downward slide movement of the sleeve relatively of said housing.

8. The filling valve mechanism of claim 7 wherein said stop means stop downward movement of said sleeve at a point short of total compression of said compressible member.

9. A counter-pressure type filling valve mechanism for cans and analogous containers, comprising:

a hollow, tubular housing;

a generally cylindrical sleeve mounted co-axially of said housing for vertical movement relatively thereto and provided with a resiliently deformable sealing ring adapted to be received within and to engage outwardly against the inner wall surface of the container upon the sleeve being lowered on the housing whereby to seal the container to the valve mechanism;

said sleeve being further provided with resiliently compressible stripping means adapted to yieldingly engage the container upon the sleeve being lowered to the container whereby to forcibly constrain the container against movement with the sleeve upon the latter being moved to a raised position on the housing following the filling of the container with liquid;

stop means formed integrally with said housing for limiting the sleeve for downward slide movement on the housing, the limit position being such as to permit the sealing ring means to enter into and sealingly engage the container and stripping means to yieldingly engage the container prior to the sleeve engaging said stop means; and roller means associated with the sleeve for controllably moving the latter between raised and lowered positions on said housing during the course of a container filling cycle.

10. The filling valve mechanism of claim 9 wherein said sleeve defines with said housing a pressure chamber adapted to communicate with the interior of a container when in sealed relation with said sleeve and operable when the container is pressurized to exert an additional force against the housing urging the latter downwardly on the housing.

11. A counter-pressure type filling valve mechanism for cans and analogous containers, comprising:

a hollow, tubular housing;

a generally cylindrical sleeve mounted to said housing for vertical movement relatively thereto and provided with a resiliently deformable sealing means adapted to engage outwardly against an inner wall surface of the container upon the sleeve being lowered on the housing whereby to seal the container to the valve mechanism;

said sleeve being further provided with a stripping means adapted to yieldingly engage the container from the upper end thereof upon the sleeve being lowered to the container whereby to forcibly constrain the container against movement with the sleeve upon the latter being moved to a raised position on the housing following the filling of the container with liquid;

stop means for limiting the sleeve for downward slide movement on the housing, the limit position being such as to permit the sealing ring means to enter into and sealingly engage the container and stripping means to yieldingly engage the container prior to the sleeve engaging said stop means, and means for controllably moving, the sleeve between raised and lowered positions on said housing.

12. The filling valve of claim 11 wherein said housing has an upper end flange and said sleeve is formed with an extension provided with opposed apertures extending vertically therethrough, and wherein said sleeve is supported for vertical movement on said housing by means of a pair of pins secured vertically to said flanged end of said housing and slidably received within corresponding of said apertures in the extension on said sleeve, the pins being connected at their opposed ends by a plate constituting the stop means for limiting the sleeve for downward slide movement on the housing.

13. The filling valve of claim 12 wherein said stripping means comprises a resilient compressible member positioned to engage a mouth of the container.

14. The filling valve of claim 13 wherein said stop means further prevents the container from receiving the weight of said sleeve, said stop means limiting downward slide movement of said sleeve prior to full compression of said resilient compressible member.

15. The filling valve of claim 14 wherein said sealing means comprises an O-ring having an outside diameter greater than an inside diameter of the inner wall surface of the container.

16. The filling valve of claim 15 wherein said O-ring is of substantially the same geometric configuration as the inner wall surface of the container.

* * * * *